United States Patent [19]

Krasberg

[11] 4,284,075

[45] Aug. 18, 1981

[54] DIVING HEADGEAR FOR USE IN RETURN-LINE DIVING SYSTEMS

[76] Inventor: Alan Krasberg, 24 Devanha Gardens, Aberdeen AB1 2UU, Scotland

[21] Appl. No.: 48,700

[22] Filed: Jun. 14, 1979

[30] Foreign Application Priority Data

Jun. 17, 1978 [GB] United Kingdom ..... 27192/78

[51] Int. Cl.[3] ..... A62B 7/00; A62B 9/02; B63C 11/14

[52] U.S. Cl. ..... 128/201.27; 128/201.28; 128/204.28; 251/DIG. 2

[58] Field of Search ..... 128/204.26, 204.27, 128/204.28, 205.16, 201.27, 201.28; 251/DIG. 2; 137/102, 494

[56] References Cited

U.S. PATENT DOCUMENTS

| | | | |
|---|---|---|---|
| 2,121,311 | 6/1938 | Anderson et al. | 128/204.27 |
| 3,149,631 | 9/1964 | Svenson | 128/204.26 |
| 3,362,429 | 1/1968 | Volsk | 128/204.26 |
| 3,474,812 | 10/1969 | Robertson | 128/204.26 X |
| 3,595,226 | 7/1971 | Newcombe | 128/142.2 |
| 3,968,795 | 7/1976 | O'Neill et al. | 128/142.3 |
| 4,182,324 | 1/1980 | Hills | 128/201.27 |

OTHER PUBLICATIONS

Perry, R. H. et al., Chemical Engineer's Handbook, 5th Edition, McGraw Hill Book Co., 1973, pp. 5-12 to 5-14, 5-33 and 5-34.

*Primary Examiner*—Charles N. Hart
*Assistant Examiner*—David R. Sadowski
*Attorney, Agent, or Firm*—Lowe, Kokjer, Kircher, Wharton & Bowman

[57] ABSTRACT

The risk of lung "squeeze" in use of diving headgear in return-line diving systems arises through the need to subject the exhaust hose to suction pressure in order to withdraw the used gas from the helmet. The usual exhaust regulating valve can quite readily jam, needs considerable servicing, and can only provide the desired high flow rates at the expense of the mechanical advantage which must however be kept high to avoid rendering the valve unduly sensitive to across-the-valve fluctuations.

According to one aspect of the invention, all of these difficulties are met by using on the helmet a novel exhaust regulating valve comprising a collapsible and expansible housing including a hinged flap and a peripheral bellows wall on the flap, an orificed seat in the housing covering an outlet opening in the housing, and a flexible membrane adjacent to the seat and connected to the flap so that hingeing movements of the flap in response to pressure variations in the helmet effect progressive laying of the membrane on to and progressive lifting of the membrane from the orificed seat. A further safety feature is a shut-off valve whereof the seating is at an inlet opening in the housing and the closure member is on the hinged flap.

According to another aspect of the invention, superior lung ventilation is obtained by using demand-type supply and exhaust valves, and spring-loading them both to the open position. It is found that the work of opening one is done by the other and vice versa, rather than by the user of the equipment.

10 Claims, 11 Drawing Figures

1
3
5
6
7
16
17
18
18A
19
21
22
23
24
29
51
52
53
54
55
56
57
58
59
60
61

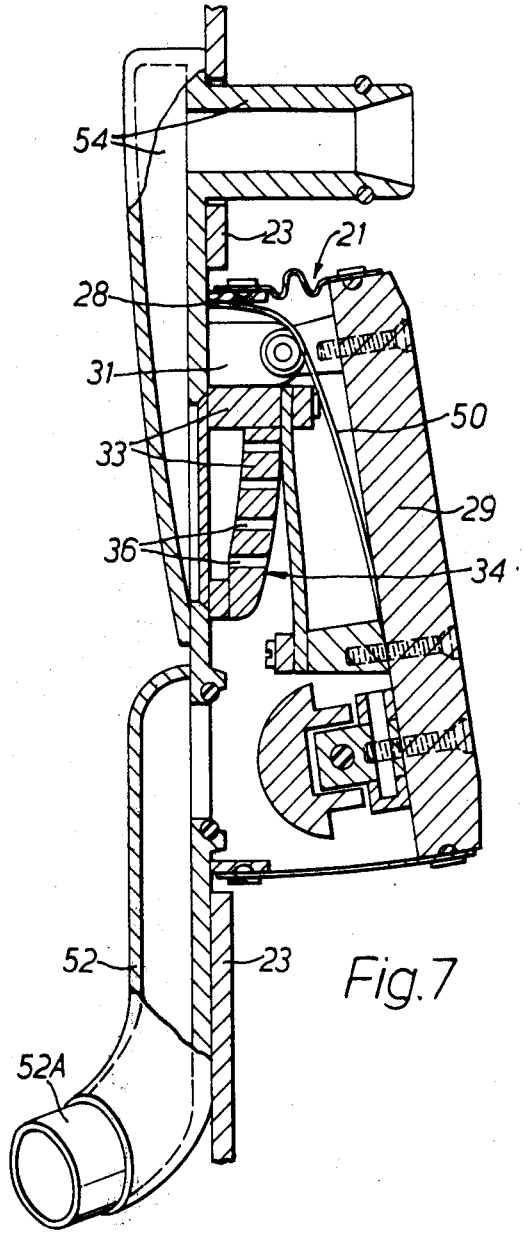
Fig.7
Fig.9
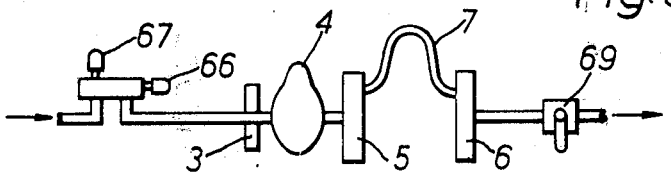

DIVING HEADGEAR FOR USE IN RETURN-LINE DIVING SYSTEMS

BACKGROUND OF THE INVENTION

This invention relates to breathing apparatus and is especially but not exclusively concerned with diving headgear for use in return-line or push-pull diving systems in which pressurized breathable gas is fed to the headgear through a supply hose, used gas is withdrawn from the headgear through an exhaust hose and pressurized, and the pressurized gas is recycled to the headgear through the supply hose. Such headgear usually comprises a helmet, an oral nasal mask in the helmet, a continuous free-flow supply valve on the helmet, and an exhaust regulating valve on the helmet actuable by the breathing of the diver to permit the withdrawal of the used gas by suction through an outlet opening in the helmet.

As the breathable gas is usually a helium/oxygen mixture, return-line diving systems have the considerable economic advantage of allowing re-use of expensive helium. However, existing return-line or push-pull diving systems have serious disadvantages. Thus, with reduced pressure in the exhaust hose to ensure efficient removal of the used gas from the helmet, failure of the exhaust regulating valve due say to jamming arising from close tolerances or to failure of sliding seals will cause lung "squeeze" which can prove fatal. Moreover, the valve systems on the helmets have hitherto been unable to meet the criteria of (a) adequate safety back-up combined with high gas-flow rates for good lung ventilation and (b) high mechanical advantage with consequent low sensitivity to across-the-valve pressure fluctuations, since the provision of large openings required for high flow rates normally results in a reduction in the mechanical advantage of the valve system.

The object of the present invention is to provide diving headgear with a valve system by virtue of which the aforesaid disadvantages in the existing return-line or push-pull diving systems are obviated or mitigated.

SUMMARY OF THE INVENTION

By providing in diving headgear an exhaust regulating valve having, according to one aspect of the invention, a hinged flap which progressively lifts and lays a flexible membrane from and on to an orificed seat plate covering the outlet opening in the valve housing, the following advantages accrue:

(a) There are no close tolerances to jam, or sliding seals to fail, and low maintenance requirements, so that diver risk is reduced.

(b) The orifices are exposed only gradually, so that suction force resisting the force opening the valve is minimal at any instant. The effect of this arrangement is to reduce downstream sensitivity to across-the-valve pressure fluctuations by a factor of 30 as compared with single-orifice valves having the same total cross-section.

(c) On start-up and throttling, the valve is very smooth.

Moreover, by using the aforesaid hinged flap additionally to lift and lower a shut-off valve member from and on to a seating at the valve inlet, the safety of the headgear is further increased, as any dangerous fall in pressure within the helmet will cause instant shut-off of the flow of gas from the helmet.

Diver safety can be still further increased by providing on the helmet an auxiliary exhaust regulating valve connected in series with the aforesaid exhaust regulating valve downstream thereof, and spring-biased open to provide enough suction for good flow but not enough to cause "squeeze" if a diver is subjected to said suction. Thus, there can be mounted compactly on the helmet four in-line automatic valves namely two regulating valves and two safety shut-off valves. Clearly, all four valves would require to fail before the diver's lungs would be subjected to "squeeze". An accident with this exhaust system is therefore most unlikely.

According to another aspect of the present invention, significant improvement in lung ventilation compared to that provided by an open-circuit demand system is obtained when supply and exhaust demand valves are spring-biased towards their open positions. It is found that valve members when so biased hold each other open when there is no flow to or from the diver. As there are continuous flows through the valves, no cracking-open of the valves from their closed positions by the force of the divers lungs is required, and the respiratory area in the helmet is flushed out with incoming gas before the start of each inhalation to give superb lung ventilation.

DESCRIPTION

One specific embodiment of the invention will now be described in detail by way of example with reference to the accompanying drawings in which:

FIG. 7 is a sectional side view taken on the line VII—VII of FIG. 6, showing the valve member in open position;

FIG. 9 is a diagrammatic view showing the disposition of the valves in relation to the oral nasal mask in the helmet;

Figure 1:
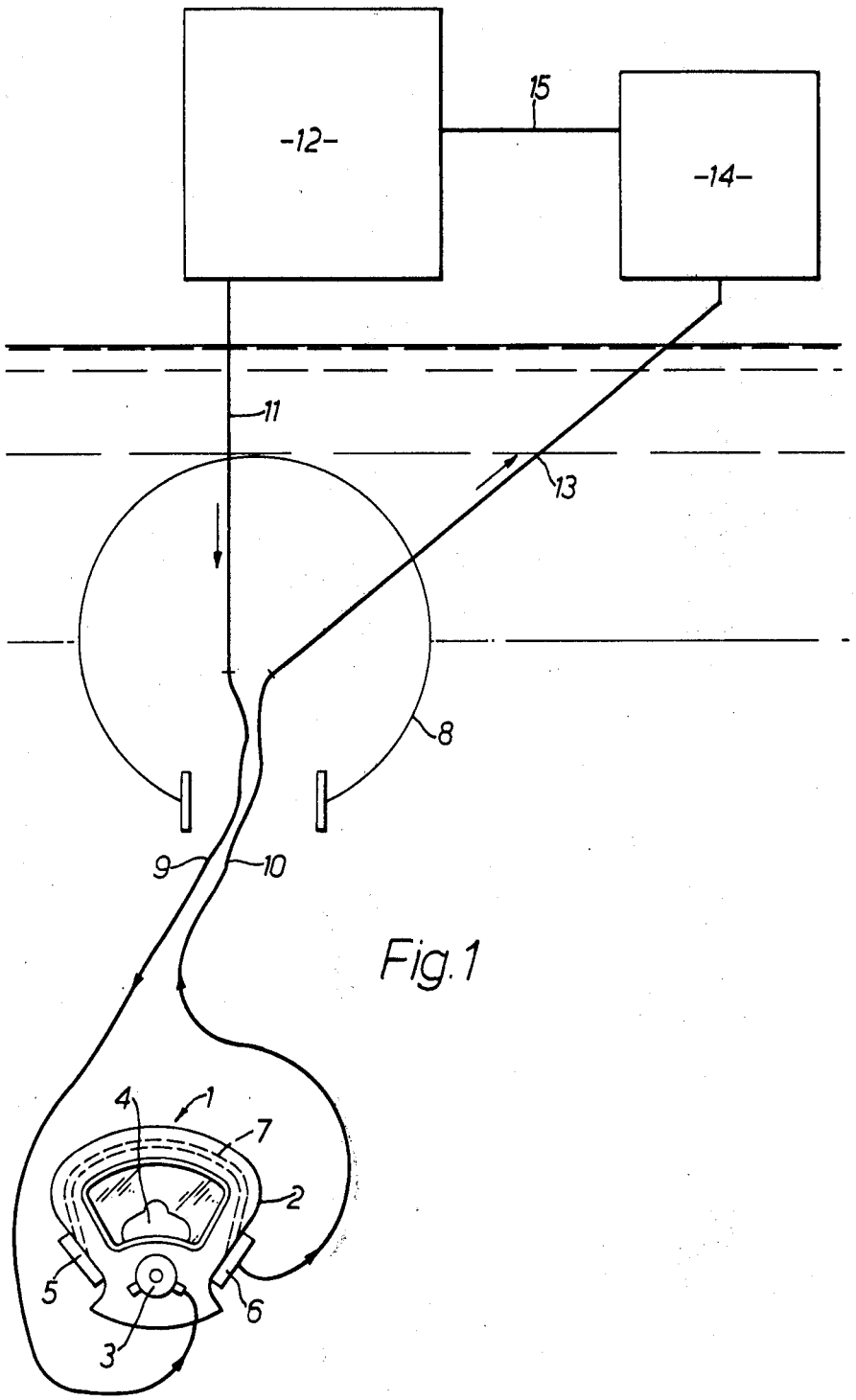
FIG. 1 is a schematic view of a return-line diving system embodying diving headgear.

Referring to the drawings:

In FIG. 1 diving headgear 1 to supply the diver with breathable gas, e.g. 94–6 He-$O_2$, includes a helmet 2 having thereon a supply regulating valve 3, an oral nasal mask 4, and an exhaust valve assembly including a main exhaust regulating valve 5 and a downstream auxiliary exhaust regulating valve 6 connected in series with valve 5 by a U-tube 7. A diving bell 8 receives the upper ends of the diver's supply and exhaust hoses 9 and 10 respectively extending from the valves 3 and 6. A bell supply line 11 extends from a control van 12 on the surface to the supply hose 9 in the bell, and a bell exhaust line 13 extends from the exhaust hose 10 in the bell to a surface unit 14 in which the used gas passes successively through scrubbers, a low-pressure volume tank, and an oxygen make-up zone into compressors, and passes from the compressors into a high-pressure volume tank. A return-line 15 connects the diver's gas in the high-pressure volume tank to the control van 12 whence the diver's gas passes into the bell supply line 11.

Figures 2, 3:
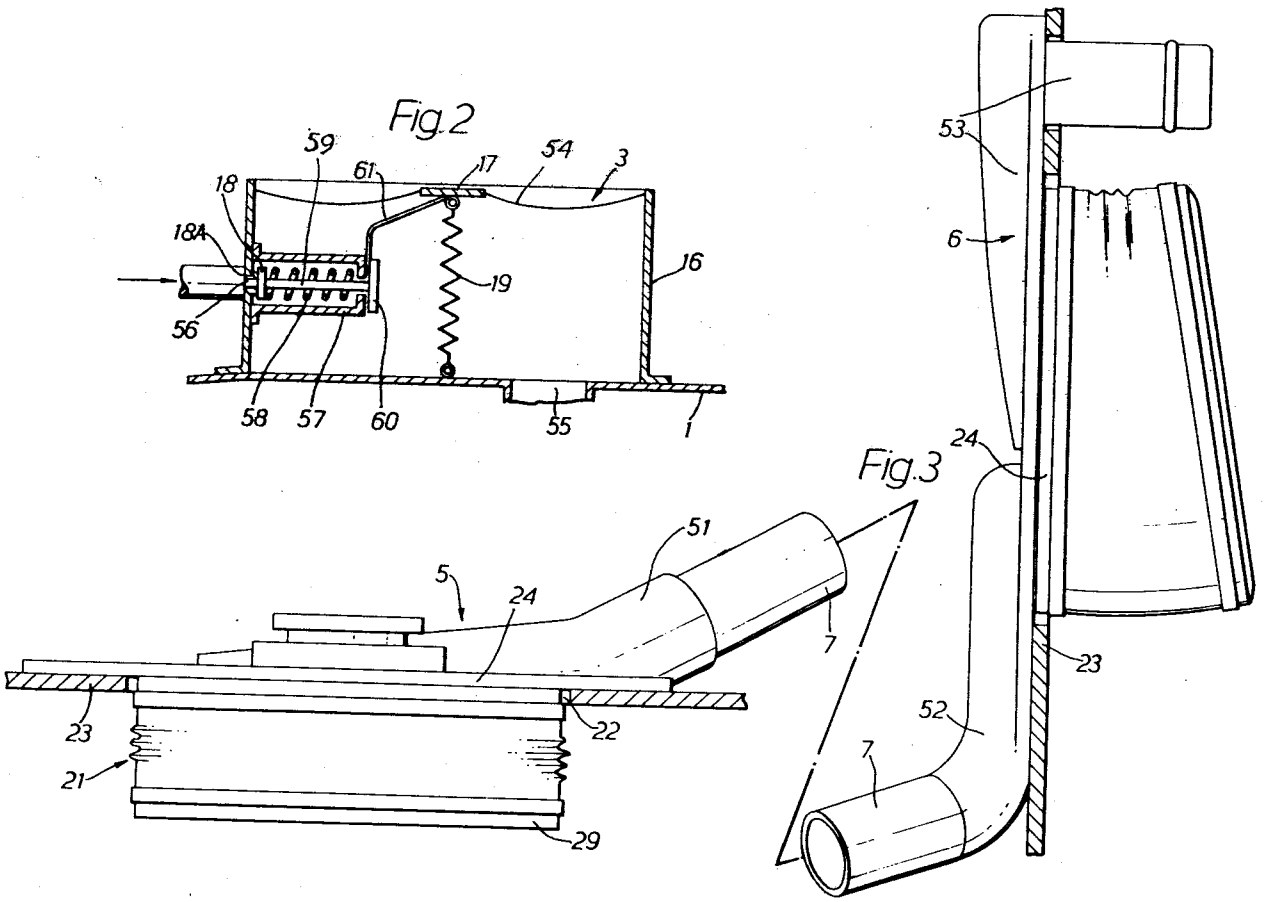
FIG. 2 is a diagrammatic sectional view of the supply regulating valve of the headgear.
FIG. 3 is an elevational view of main and auxiliary exhaust regulating valves interconnected in series on the helmet.

In FIG. 2 the supply regulating valve 3 has on the helmet wall 1 a housing consisting of a cylindrical wall 16, a central disc 17, and an annular diaphragm 54 extending between the disc and the wall for exposure to sea-water pressure, there being an outlet opening 55 in the housing communicating with the helmet interior. An inlet opening 56 connected to the supply of pressurized gas communicates with a chamber 57 in which a valve disc 18 is reciprocable towards and from a seat 18A at the opening 56. A compression spring 58 in the chamber 57 urges the valve disc 18 to closed position on the seat. A stem 59 on the valve disc 18 has thereon outwith the chamber a disc 60 engaged by a lever 61 extending from the disc 17. Inhalation draws the diaphragm inwards whereupon the lever 61 pries the disc 60 against spring action away from the chamber 57 to cause lifting movement of the valve disc 18 from the seat 18A and so open the valve. According to an aspect of the invention to be described fully hereinafter, the disc 17 is connected to the helmet wall 1 by a tension spring 19 which in tending to draw the diaphragm inwards supplements the water pressure and acts through the lever 61 to bias the valve to open position, thereby tending to increase the pressure maintained by the valve.

Figure 5:
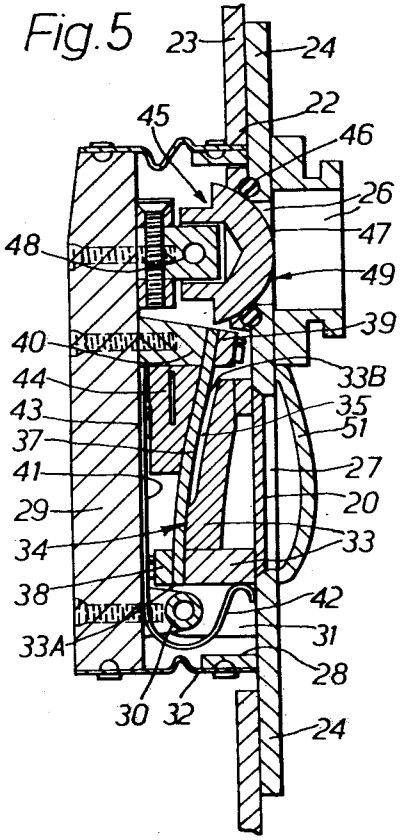
FIG. 5 is a sectional side view, taken on the line V—V of FIG. 4, showing the valve member in closed position.
Figure 4:
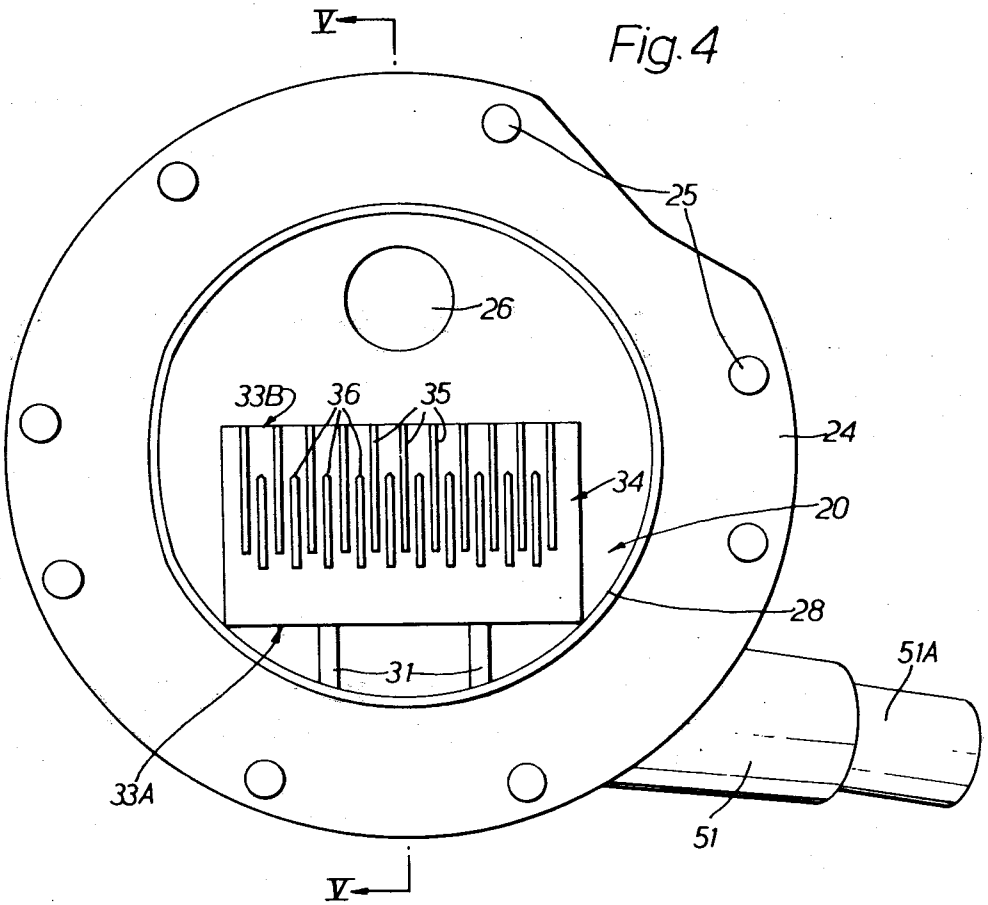
FIG. 4 is a front view of the main valve of FIG. 3, with the top removed.

In FIGS. 3 to 5 the main exhaust regulating valve 5 comprises a collapsible circular housing 21 projecting outwardly through a circular hole 22 in the wall 23 of the helmet and including a base plate 24 which is secured to the wall 23 by fastenings at locations 25 and has therein a circular inlet opening 26 and a rectangular outlet opening 27. The housing includes also a base ring 28 secured to the base plate 24, a disc-shaped flap 29 pivotally mounted on a hinge pin 30 carried by brackets 31 on the base plate 24, and an annular bellows wall 32 of siliconised nylon sealingly connected to the ring 28 and to the flap 29.

A filter 20 is provided in the outlet opening 27.

A seat 33 of generally elongate box shape is secured to the base plate 24 and covers the outlet opening 27. The seat surface 34 has a longitudinal edge 33A closely alongside the hinge pin 30 of the flap 29 and slopes transversely and inwards towards the helmet in an arc extending to the opposite longitudinal edge 33B. A series of transverse shallow grooves 35 in the seat surface 34 extends inwards from the edge 33B, and a central series of orifices in the form of transverse through-slots 36 are formed in the seat between the grooves 35. An elongate rectangular flexible membrane 37 of natural rubber has one longitudinal margin clamped by a bar 38 to the longitudinal margin of the seat 33 and has the opposite longitudinal margin clamped by a bar 39 to the sloped top face of a wall 40 on the flap 29. A pad 44 of open-cell foamed plastics material is interposed between the membrane 37 and the flap 29. With the flap 29 in closed position the membrane 37 engages the surface 34 to close the slots 36, and on pivoting of the flap 29 to and fro the membrane is progressively lifted from and laid on the the surface 34 of the seat 33 to uncover progressively and cover progressively the slots 36.

In the valve 5, according to an aspect of this invention, a biasing spring 41 is provided having one end portion 42 extending around the flap hinge pin 30 and connected to the seat 33, and has the opposite end portion 43 connected to the flap 29 so that the valve is biased to open position for the purpose hereinafter set forth.

The inlet opening 26 of the valve is closable by a shut-off valve 45 when the gas pressure in the helmet falls dangerously low. This valve 45 consists of a seat including an O-ring 46 adjacent to the opening, and a closure member 47 mounted for universal movement at 48 on the flap 29 and having a dome face 49 for engagement with the O-ring 46.

Figure 6:
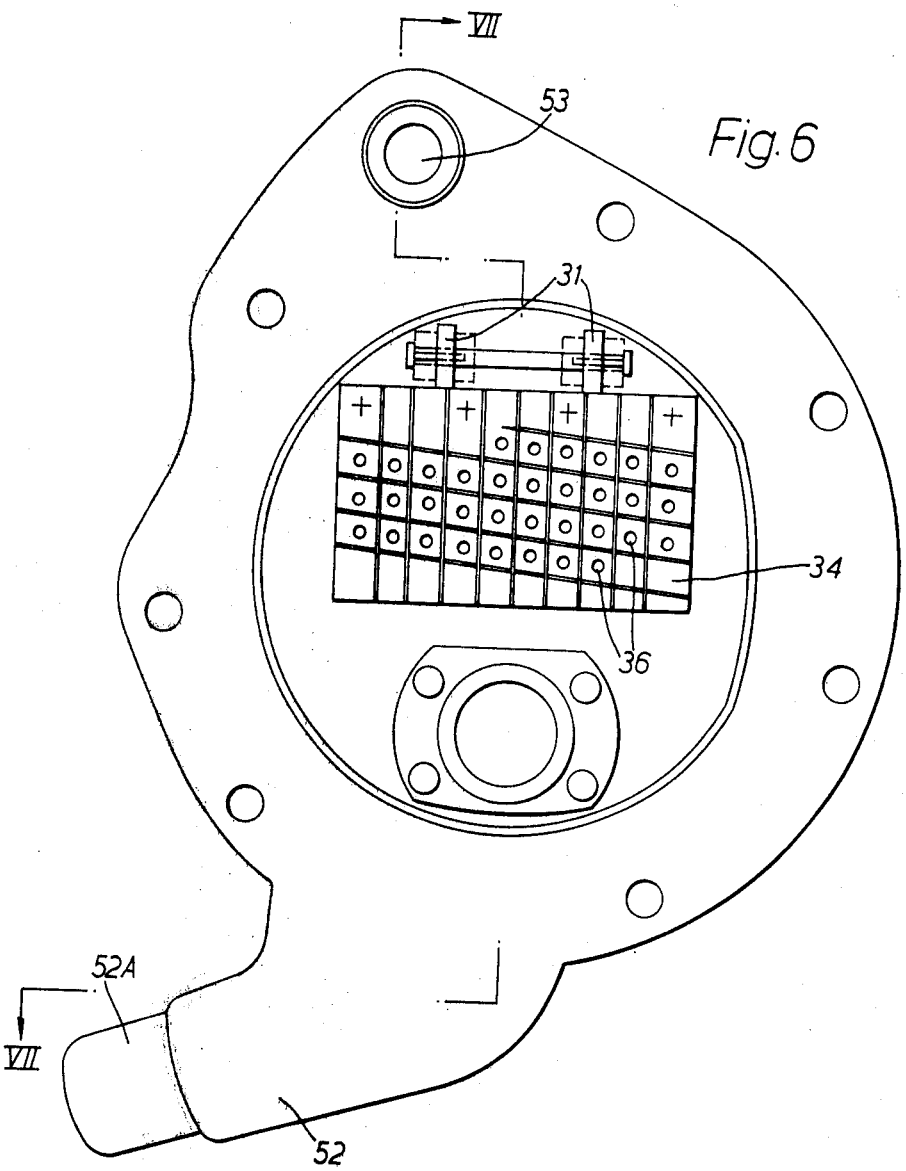
FIG. 6 is a front view of the auxiliary valve of FIG. 3 with the top removed.

In FIGS. 3, 6 and 7, the auxiliary exhaust regulating valve 6 is similar in construction to the main valve 5, except that the orifices 36 are circular holes instead of slots, and the pressure pad is omitted. A leaf spring 50 has one end engaging the base ring 28 and the other end engaging the flap 29 to bias the valve to an open position providing enough suction for good flow but not enough to cause squeeze if a diver is subjected to said suction.

Duct formations 51 and 52 extending from the outlet and inlet openings of the respective valves 5 and 6 are coupled by the pipe 7 which engages spigots 51A and 52A on the formations, and a duct formation 53 extends from the outlet opening of the valve 6 and is coupled to the diver's exhaust hose 10.

Figure 8:
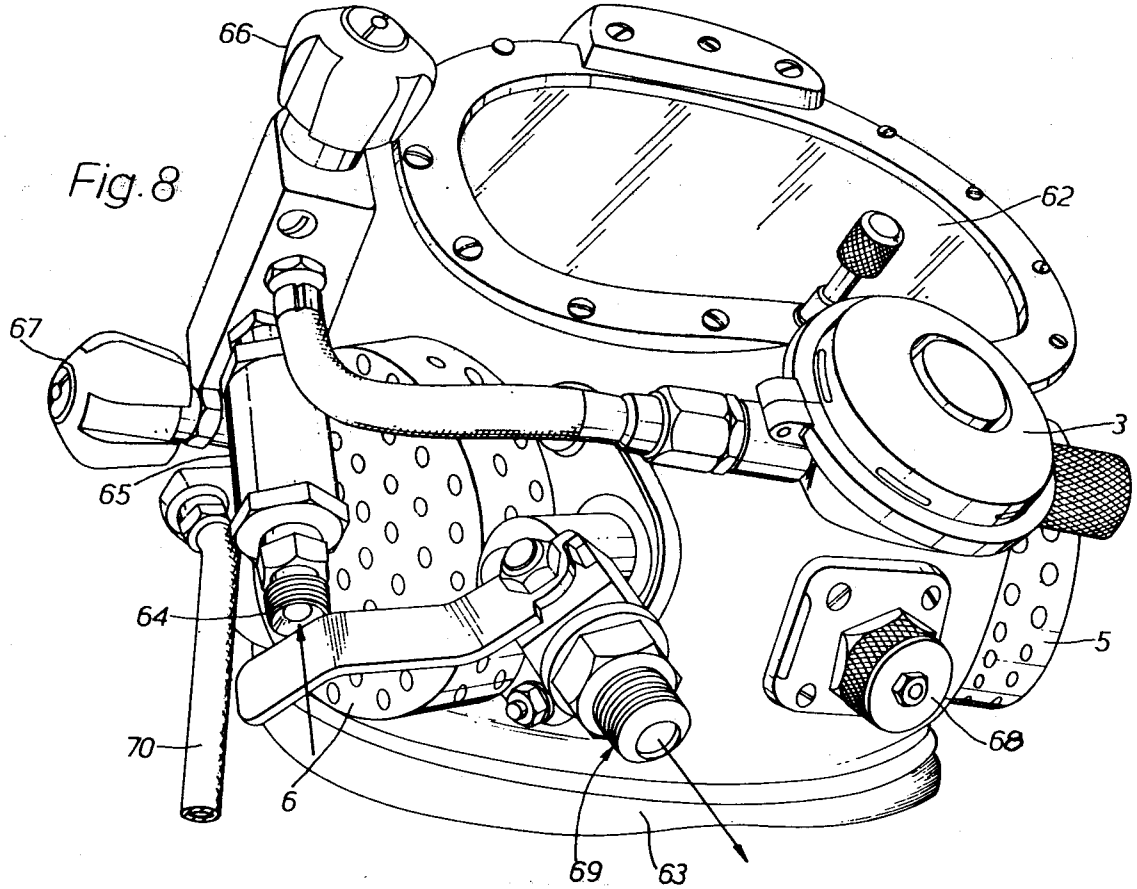
FIG. 8 is an underneath perspective view of the headgear showing the layout of the valves on the helmet.

In FIG. 8 the helmet 1 has a face plate 62 and a neck portion 63. The supply regulating valve is indicated at 3, and the main and auxiliary exhaust regulating valves are under protective covers indicated respectively at 5 and 6. 64 is the gas inlet port, 65 is a non-return valve in the supply line, 66 is a free-flow handle, 67 is an emergency gas supply handle, 68 is an adjustable relief valve for open-circuit exhaust, 69 is a return-line manual valve, and 70 is a communications cable.

The line of flow of the gas through the valves is indicated in FIG. 9. The mask 4 is of course disposed within the helmet as is the U-tube 7 which extends from side to side of the helmet to lie over the top of the diver's head.

Figure 10:
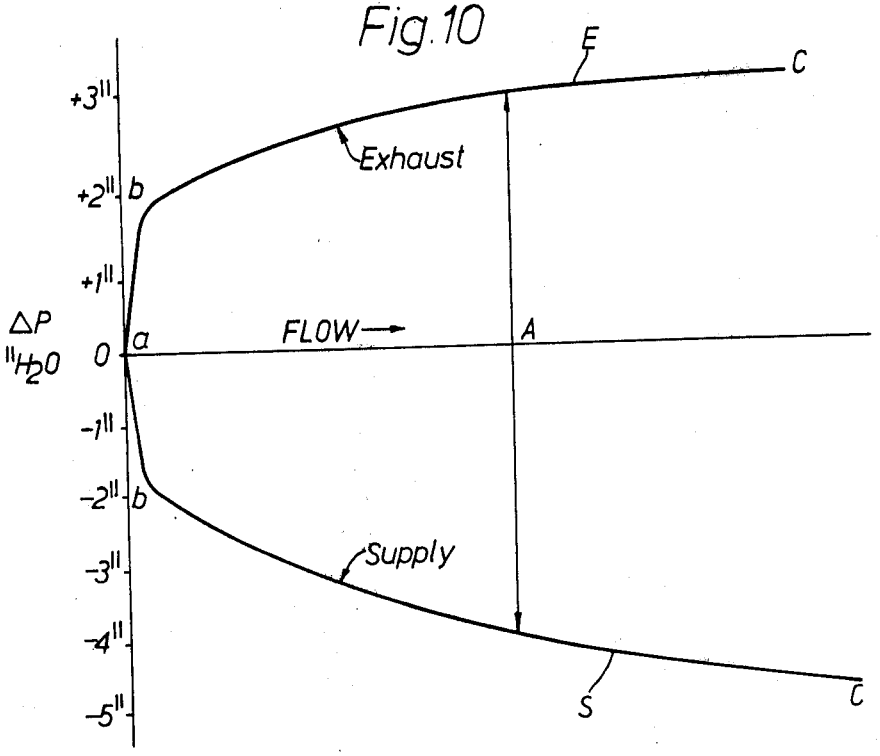
FIG. 10 is a flow diagram of the opening of the supply and exhaust regulating valves of the return-line headgear before spring-biasing of the valve members.

In FIG. 10 the pressure/flow curve for a typical supply regulating valve is indicated at S, and the pressure/flow curve for a typical exhaust regulating valve is indicated at E. Typically, for a supply flow "A" units, a suction pressure of 4 inches of water is required, and for an exhaust flow of "A" units a positive pressure of 2½ inches of water is required. In each curve, an initial sticking and cracking portion a–b shows little or no flow during the initial cracking open of the valve member from its seat, and the main portion b–c shows a rapid increase in flow following the cracking open of the valve member.

An important aspect of this invention is based on the discovery that on biasing both of the valves 3 and 5 towards their open positions so that the curves E and S cross each other at a pressure of only a few inches of water, both valves are open during the changeover from inhalation to exhalation and vice versa, there being a continuous flow through the system with each valve holding the other open. Use is now made of this phenomenon by biasing the valves to such an extent that the work of opening each valve at the sticking and cracking portion a–b of the curve E or S is substantially done by the other valve, and not by the diver.

Figure 11:
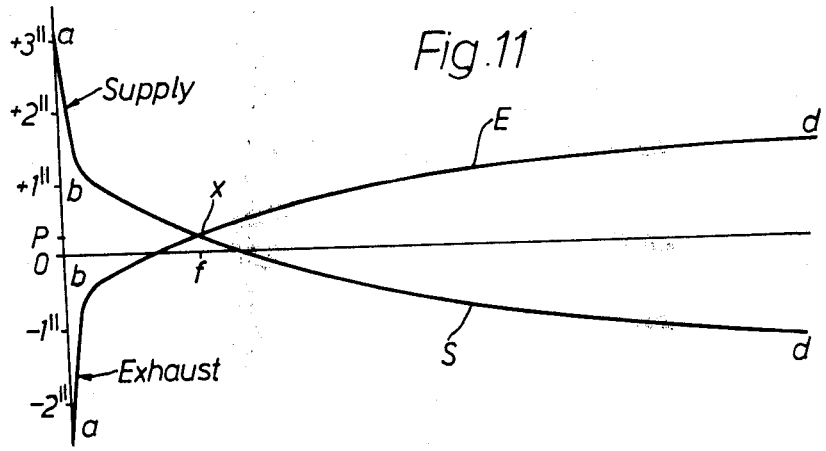
FIG. 11 is a flow diagram of the opening of the biased supply and exhaust regulating valves of the headgear.

In the exemplary embodiment presently described the biasing of the valves 3 and 5 to their open positions is effected by springs 19 and 41 respectively, and the effects of the biasing are illustrated in FIG. 11. Thus, by providing the supply valve 3 with a spring bias to open position equivalent to about 3 inches of water and by providing the exhaust valve 5 with a spring bias equivalent to about 2 inches of water the two curves E and S cross each other at x, that is, the static condition is at a pressure P near 0 inches of water and at a flow F. With both valves already open, the diver may initiate either inhalation or exhalation without having to supply the "cracking" force himself.

Inhaling or exhaling will disturb this static condition. An inhalation, for example, will reduce the pressure in the helmet slightly. Referring to FIG. 11, it can clearly be seen that this results in both an increase of flow into the helmet from the supply, and a decrease of flow from the helmet to the exhaust. The sum of these two changes is of course going to the diver's lungs. It follows that a given net flow into (or conversely out of) the diver's lungs is achieved with a smaller pressure differential than with either the supply valve or the exhaust valve acting alone, even if the cracking pressure were overcome by some other means. Thus, by combining an active supply valve with an active exhaust valve, and providing the proper biasing to open position, the work of breathing can be greatly reduced.

It will be appreciated that the benefits of this aspect of the invention are obtainable by biasing to open position either one of the supply and exhaust valves 3 and 5, as such biasing has the effect of bringing closer together the two curves E and S. Moreover, it will be clear that the breathing system of this aspect of the invention can readily be embodied in breathing apparatus other than diving headgear. Therefore, the present invention broadly contemplates the provision in breathing apparatus of a breathing system comprising a demand pressure regulating valve at the supply to the system and a demand suction regulating valve at the exhaust from the system, wherein at least one of said valves is biased to open position so that the work of opening one of the valves is done wholly or partly by the other valve.

I claim:

1. In return-line diving apparatus, exhaust valve means for regulating the flow of used gas from the diver into the return line comprising in combination:

a. a base structure having inlet and outlet openings therein and an orificed seat between the openings;
b. a flap pivotally mounted on the base structure and extending radially outwards over the openings for movement towards and from the seat;
c. a collapsible peripheral wall connecting the flap to the base structure and forming with the flap a collapsible housing containing the orificed seat and exposable to the ambient water; and
d. a flexible membrane in the housing extending radially outwards between the seat and the flap and connected at its inner and outer ends respectively to the base structure and to the flap so that when the flap pivots in response to the diver's breathing the membrane progressively engages with and disengages from the seat to close and open progressively the orificing of the seat.

2. Exhaust valve means according to claim 1, wherein the base structure includes a base plate having the openings therein and the orificed seat is an orificed portion of a casing on the base plate enclosing the outlet opening; and shut-off means are provided comprising an annular seat on the base plate at the inlet opening, and a member on the flap engageable with the seat to close the inlet opening in the event of failure of the membrane.

3. Exhaust valve means according to claim 1, including spring means in the housing between the base structure and the flap urging the flap outwards from the base structure.

4. In return-line diving apparatus, exhaust valve means for regulating the flow of used gas from the diver into the return line comprising in combination:

a. a base structure having inlet and outlet openings therein and an orificed seat between the openings;
b. a flap pivotally mounted on the base structure with the pivotal axis of the flap lying closely alongside an axially extending margin of the surface of the seat and the flap extending radially outwards over the openings for movement towards and from the seat;
c. a collapsible peripheral wall connecting the flap to the base structure and forming with the flap a housing for exposure to the ambient water; and
d. a flexible membrane in the housing extending radially outwards between the flap and the seat and having a pair of opposed inner and outer axially extending margins whereof the inner margin is anchored to said margin of the surface of the seat and the outer margin is connected to the flap so that when the flap pivots in response to the diver's breathing the membrane progressively seats and unseats to close and open progressively the orificing of the seat.

5. In return-line diving apparatus, exhaust valve means for regulating the flow of used gas from the diver into the return line comprising in combination:

a. a base structure including a base plate having inlet and outlet openings therein and a casing on the base plate extending over the outlet opening and having an orificed seat portion;
b. a flap pivotally mounted on the base plate at the end of the casing remote from the inlet opening, and extending radially outwards over the seat portion and the inlet opening;
c. a collapsible peripheral wall connecting the flap to the base plate and forming with the flap a housing for exposure to the ambient water; and
d. a flexible membrane in the housing extending radially outwards between the seat portion and the flap and connected at its inner and outer ends respectively to the casing and to the flap so that on pivotal movement of the flap in response to the diver's breathing there is progressive seating and unseating of the membrane to close and open progressively the orificing of the seat.

6. Exhaust valve means according to claim 5, including spring means in the housing between the base plate and the flap urging the flap outwards from the base plate.

7. In return-line diving apparatus, exhaust valve means for regulating the flow of used gas from the diver into the return line comprising in combination:

a. a base structure including a base plate having inlet and outlet openings therein and a casing on the base plate extending over the outlet opening and having an orificed seat portion;

b. a flap pivotally mounted on the base plate at the end of the casing remote from the inlet opening, and extending radially outwards over the seat portion and the inlet opening;

c. a collapsible peripheral wall connecting the flap to the base plate and forming with the flap a housing for exposure to the ambient water;

d. a flexible membrane in the housing extending radially outwards between the seat portion and the flap and connected at its inner and outer ends respectively to the casing and to the flap so that on pivotal movement of the flap in response to the diver's breathing there is progressive seating and unseating of the membrane to close and open progressively the orificing of the seat; and e. shut-off means including an annular seat on the base plate at the inlet opening, and a member on the flap engageable with the seat to close the inlet opening in the event that the gas pressure falls below safety level.

8. A return-line diving helmet including a shell to enclose the diver's head, a supply regulating valve on the shell responsive to the breathing of the diver to permit a flow of breathable gas from a source into the shell, and exhaust-regulating valve means on the shell responsive to the breathing of the diver to permit a flow of used gas from the shell into a return line, wherein the exhaust regulating valve means include a pair of exhaust valves connected together for series throughflow of used gas and each comprising, in combination:

a. a base structure having inlet and outlet openings therein and an orificed seat between the openings;

b. a flap pivotally mounted on the base structure and extending radially outwards over the openings for movement towards and from the seat;

c. a collapsible peripheral wall connecting the flap to the base structure and forming with the flap a collapsible housing containing the orificed seat and exposable to the ambient water; and d. a flexible membrane in the housing extending radially outwards between the seat and the flap and connected at its inner and outer ends respectively to the base structure and to the flap so that when the flap pivots in response to the diver's breathing the membrane progressively engages with and disengages from the seat to close and open progressively the orificing of the seat.

9. A diving helmet according to claim 8, wherein:

a. the supply regulating valve includes a member spring-urged to an open position, and b. in each exhaust valve spring means are disposed in the housing between the base structure and the flap to urge the flap outwards from the base structure.

10. A diving helmet according to claim 8, wherein each exhaust valve has a base structure which includes a base plate having the inlet and outlet openings therein and a casing on the base plate enclosing the outlet opening and having an orificed portion forming the orificed seat, and each exhaust valve includes shut-off means comprising an annular seat on the base plate at the inlet opening, and a member on the flap engageable with the seat to close the inlet opening in the event of failure of the membrane.

* * * * *